US006547162B1

(12) United States Patent
de Regt et al.

(10) Patent No.: US 6,547,162 B1
(45) Date of Patent: Apr. 15, 2003

(54) FOAM SPRAYING DEVICE

(75) Inventors: Jeroen de Regt, VP Oss (NL); Roy van Swieten, JG Oud-Heusden (NL)

(73) Assignee: Keltub B.V., Vlijmen (NL)

( * ) Notice: Subject to any disclaimer, the term of this patent is extended or adjusted under 35 U.S.C. 154(b) by 0 days.

(21) Appl. No.: 09/673,775

(22) PCT Filed: Apr. 18, 1999

(86) PCT No.: PCT/IB99/00704

§ 371 (c)(1),
(2), (4) Date: Dec. 8, 2000

(87) PCT Pub. No.: WO99/54054

PCT Pub. Date: Oct. 28, 1999

(30) Foreign Application Priority Data

Apr. 17, 1998 (CH) ..... 879/98

(51) Int. Cl.[7] ..... B05B 9/043

(52) U.S. Cl. ..... 239/333; 239/1; 239/350; 239/353; 239/357; 239/413; 239/419; 222/190; 222/321.9

(58) Field of Search ..... 239/398, 8, 333, 239/343, 344, 350, 353, 357, 360, 370, 409, 413, 419, 426, 427, 434, 590.3, 590, 369; 222/190, 321.1, 321.9, 145.1

(56) References Cited

U.S. PATENT DOCUMENTS 4,932,567 A * 6/1990 Tanabe et al. ..... 239/343
5,064,103 A * 11/1991 Bennett ..... 239/343
5,443,569 A * 8/1995 Uehira et al. ..... 222/190
5,570,819 A * 11/1996 Uehira et al. ..... 222/190
5,813,576 A * 9/1998 Iizuka et al. ..... 222/190
5,918,771 A * 7/1999 van der Heijden ..... 222/190
6,053,364 A * 4/2000 van der Heijden ..... 222/190
6,082,586 A * 7/2000 Banks ..... 222/190

FOREIGN PATENT DOCUMENTS

| | | |
|---|---|---|
| EP | 0392238 | 3/1990 |
| FR | 317969 | 11/2002 |
| WO | 9313829 | 7/1993 |

* cited by examiner

*Primary Examiner*—Steven J. Ganey
(74) *Attorney, Agent, or Firm*—Janet Sleath; Lisa N. Benado

(57) ABSTRACT

A new foam spraying apparatus 1 is described for a liquid container. It comprises a piston and cylinder unit (20; 37) for the air and a piston and cylinder unit (21; 38) for the liquid in which arrangement the piston and cylinder units (20, 37; 21, 38) each are provided with an inlet valve (30; 44) and with an outlet valve (24) and are co-operating being coupled to each other. Furthermore a mixing chamber (14) for the mixture of air and liquid and a spraying head (2) with a foam delivery opening (9) are provided. The cylinder (20) of the first unit and the piston (21) of the second unit are interconnected to an intermediate part (5). Furthermore the piston (37) of the first unit and the cylinder (38) of the second unit are also interconnected to a base part (4) in such a manner that the intermediate part (5) and the base part (4) mesh and are movable relative to each other.

11 Claims, 3 Drawing Sheets

FOAM SPRAYING DEVICE

BACKGROUND OF THE INVENTION

1. Technical Field

The present invention relates to a foam spraying apparatus according to the introductory part of the claim 1.

2. Description of the Related Art

A foam spraying device of such type is known e.g. from the International Patent Application WO-A-93/13829. There a foam spraying device is described with a container containing a foamable liquid, a valve, a delivery opening for the foam generated as well as a sieve between the delivery opening and the valve for obtaining the desired mixture of liquid and air. Furthermore between the valve and the sieve a perforated disk is provided in which the perforations in the form of holes or slots are arranged along the periphery in order to better mix liquid and air. By using a pump a pressure within the container is built up. A conventional spraying nozzle shall be moved against the force of a pressure spring towards the container body so that the air is entered and mixed with the liquid by means of the sieve and the perforated disk in such a manner that a foam is formed and is given off at the delivery opening.

This known foam spraying device comprises a multitude of individual parts made from various materials such as synthetic materials and metals. Manufacture of a foam spraying device of this type thus is rather expensive. It is a further disadvantage of the known foam spraying device that for generating sufficient pressure within the container the pump must be operated several times before foam can be delivered.

Furthermore from the European Patent Application EP-A-0 392 238 a foam spraying device is known with a shifting piston or media pump for the liquid and an air compressor pump each provided with an inlet valve and an outlet valve. The air compressor pump is arranged on the same axis with, and adjoining, the media pump, both pumps being operated at the same time using a cap-shaped handle. In this arrangement the back piston end of the shifting piston pump is provided with a long piston shaft in which a shaft with a disk-shaped valve closing element is arranged. A set-back spring is provided between the bottom wall and the valve closing element. For generating foam a mixing chamber with an adjacent foaming body is provided.

This foam spraying device also comprises a great number of individual elements which present particularly complex shapes in order to ensure correct co-operation. Due to the line-up of the air compressor pump and the media pump this device is of considerable length which impedes operation.

On the other hand from the French Patent Application FR-A-2 317 969 a spray device is known which comprises two pumps, one for the air and one for the liquid, arranged between the spray head and the liquid container. The liquid pump consists of two tubes shiftable inside each other of which tubes the lower one can be closed against the liquid container by a valve body with a hollow plunger. The spraying cap also forms the cylinder of the air pump which can be moved up and down inside a shorter cylinder portion of a larger diameter. The spraying cap furthermore is provided in its upper zone with a spraying nozzle with a mixing chamber which via valve-like structures is connected to the air pump and the liquid pump. Using a very complex design lay-out with small ducts the connection is ensured between the cylinder elements and the air pump and the liquid pump.

No mixing chamber with a foaming body being provided and thus no foam can be generated using the proposed spraying device.

The spaying device so described also comprises a great many individual parts made from various materials. The intake tube e.g. is made from extruded polythene and the spraying cone is injection moulded from polythene. The valve body and the plunger can be made from low density polythene.

SUMMARY OF THE INVENTION

It is the objective of the present invention to improve a foam spraying apparatus of the type described above in such a manner that it comprises a substantially reduced number of individual parts and permits foam generation in a simple manner.

These objectives are met using an apparatus presenting the characteristics according to the patent claim 1.

The inventive foam spraying apparatus for a liquid container with an air suction device, a mixing chamber for the air and liquid blend and a spaying head with a foam delivery opening comprises between the spraying head and the liquid container a first piston and cylinder unit for the air and a second piston and cylinder unit for the liquid each provided with an inlet valve and an outlet valve which co-operate being mutually coupled. Thus the inventive foam spraying apparatus presents the substantial advantage that in one manual movement air is compressed as well as liquid is expulsed whereas during expansion of the spraying head air and liquid are sucked in again. In this fast and simple manner a large quantity of foam can be generated without application of the usual propellant gases. The inventive foam spraying apparatus furthermore is characterised in that the cylinder of the first unit and the piston of the second unit are interconnected to an intermediate part and that the piston and the cylinder of the second unit are interconnected to a base part in such a manner that the intermediate part and the base part engage one another movable relative to each other.

In an advantageous embodiment of the present invention the cylinder of a first unit and the piston of the second unit form a unit body as intermediate part and the piston of the first unit and the cylinder of the second unit form a unit body as base part. In a further advantageous embodiment the piston of the second unit is laid out eccentrically with respect to the first unit. In this arrangement a space saving engagement of the two piston and cylinder units is obtained A further variant is laid out in such a manner that the piston of the second unit is arranged concentrically with the cylinder of the first unit, i.e. inside the latter unit. This presents the advantage that the insert containing the mixing chamber is shorter and thus an optimum layout of the foam spraying apparatus can be achieved It proves advantageous to provide the pistons of both units each with a sealing ring in order to ensure optimal intake of air and liquid.

Advantageously the mixing chamber is formed by an insert between the spraying head and the intermediate element. In this arrangement the mixing chamber can present a tapered inlet opening for the air and a tapered inlet opening for the liquid. For correct foam generation it has proven advantageous if after the air inlet opening and after the liquid inlet opening, as seen in the flow direction, a fine mesh sieve is provided. It has proven particularly advantageous if a foaming chamber with a second fine mesh sieve is provided. In practical use it has proven useful if the spraying head, the insert, the intermediate element, and the base part are made from an injection moulded hard synthetic material.

Manufacture of the foam spraying apparatus advantageously is effected using injection moulding of a two-component synthetic material. Particularly proven is if simultaneously the elements serving as valves and as sealing rings made from a rubber plastic synthetic material in the injection moulding process are surrounded by the corresponding elements coordinated to them.

Manufacture of the inventive foam spraying apparatus thus is much simpler and more cost-efficient as only a small number of individual parts is required.

BRIEF DESCRIPTION OF THE FIGURES

Further advantages of the invention are described in the dependent claims and in the following description in which the present invention is discussed in more detail with reference to a design example illustrated in the schematic drawings. It is shown in:

In the Figures identical elements are designated by the same reference signs and explanations given pertain to all subsequent Figures unless stated otherwise.

DETAILED DESCRIPTION OF THE INVENTION

Figure 1:
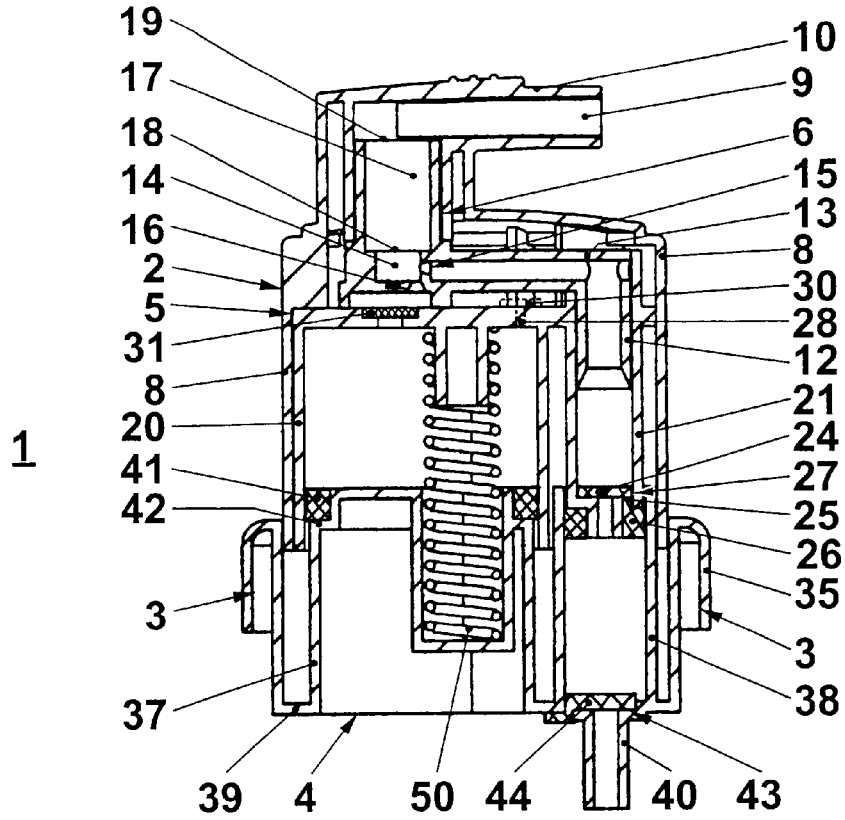
FIG. 1 a cross-sectional view of a foam spraying apparatus with a spraying head and a screw-on part for the container (not shown) in its released state, FIG. 2 the same foam spraying apparatus according to the FIG. 1 in its compressed state, FIG. 3 an axonometric view of the foam spraying apparatus according to the FIG. 1, FIG. 4 an axonometric view of the foam spraying apparatus according to the FIG. 2, and FIG. 5 an axonometric exploded view of the foam spraying apparatus.
Figure 2:
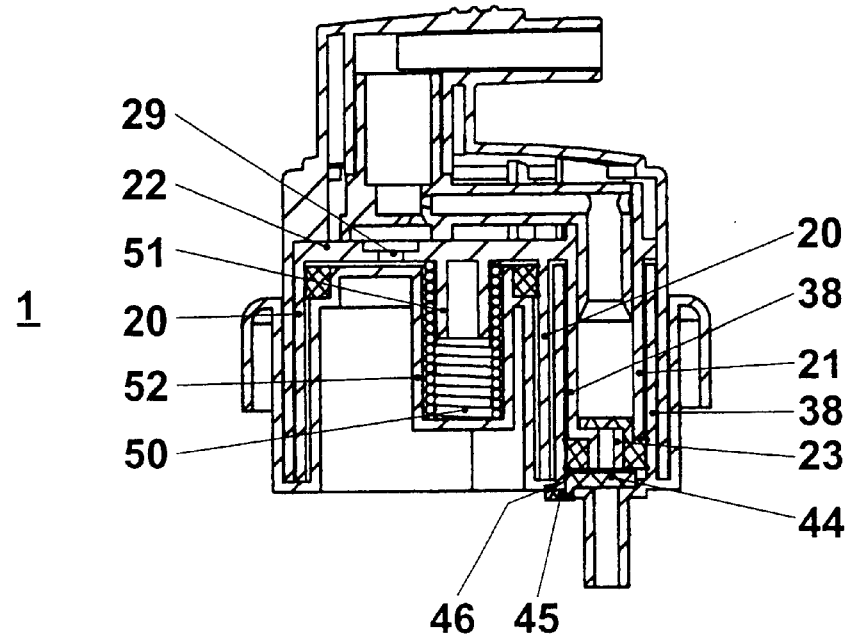
Figure 4:
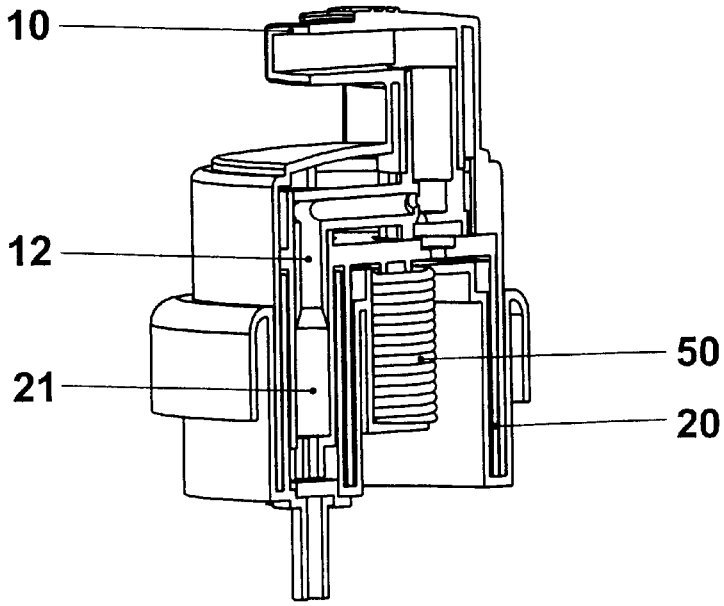

In the FIGS. 1 and 2 a cross-sectional view is shown of a foam spraying apparatus 1 which can be screwed onto a container or bottle (not shown). This apparatus 1 essentially comprises four parts, namely a spraying head 2, a base part 4 provided with a threaded portion 3, an intermediate part 5 and an insert 6. The spraying head 2 essentially presents a circular cylindrical envelope surface 8 with a foam conducting tube 10 forming a foam delivery opening 9. The insert 6 is formed by a circular cylindrical flow chamber 12 for the liquid, a connecting tube 13, a mixing chamber 14 with a tapered inlet opening 15 for the liquid and a tapered inlet opening 16 for air, and a foaming chamber 17 with two circular sieves 18 and 19. The intermediate part 5 essentially consists of a cylindrical air chamber 20 and a cylindrical piston 21 for the liquid, which are interconnected via a circular plate 22 (compare FIG. 4). The piston 21 furthermore comprises a tubular protrusion 23 of a smaller diameter. A rubber elastic disk 24 acting as a valve is connected via a cross-member 25 with a sealing ring 26 arched towards the inside. For fastening the disk 24 and the sealing ring 26, which are interconnected and form a unit, a passageway 27 is provided between the piston 21 and the protrusion 23. Also an inlet opening 28 (compare FIG. 5) and an outlet opening 29 are provided in the air chamber 20 which are sealed by rubber elastic disks 30 and 31 acting as valves, the disk 31 of the outlet opening 29 only being visible. These disks are similar to the disk 24 with the cross member 25, in which arrangement on the counter side a smaller rubber elastic disk or a similar element is provided for fastening the disk. The base part 4 is provided with an outer ring 35 with a threaded portion 3 and forms a cylindrical piston 37 for the air and a circular cylindrical liquid chamber 38 which are interconnected via a cross-member,39 formed by a cut-out circular plate. The liquid chamber 38 is provided with a intake tube 40 of smaller diameter extending into the container or bottle (not shown). The piston 37 on its side opposite the air chamber 20 is provided with a sealing ring 41 arched towards the inside and inserted into a seat 42. Furthermore on the intake tube 40 on its side opposite the liquid chamber 38 a valve seat 43 is provided, into which a rubber elastic disk 44 is inserted as a valve. The disk 44 is connected to an L-shaped connecting element 45 which extends via a passageway opening 46 between the liquid chamber 38 and the intake or aspiration tube 40.

As can be seen from the above description the cylindrical air chamber 20 and the correspondingly formed cylindrical piston 37 form a first piston and cylinder unit for pressing the air into the mixing chamber 14. Similarly the cylindrical piston 21 and the cylindrically formed circular liquid chamber 38 form a second piston and cylinder unit for the liquid. In this arrangement the rubber elastic disks 30 and 44 each serve as inlet valves and the disk 31 of the outlet opening 29 and the disk 24 serve as outlet valves.

Figure 3:
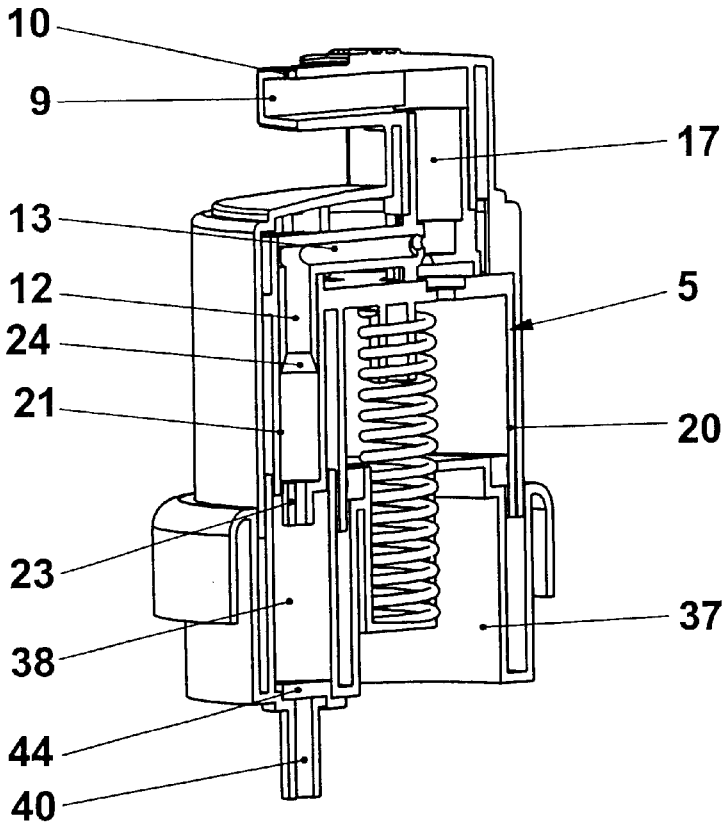

As further can be seen from FIG. 1 between the intermediate part 5 and the base part 4 in the zone between the air chamber 20 and the liquid chamber 38 a helical spring 50 is provided which on the one hand rests against a tubular protrusion 51 in the air chamber 20 and on the other hand is inserted into a stepped tube 52 of the piston 37. Thus the two parts 4 and 5 in their released state are distanced at a certain distance (as indicated in the state shown in FIGS. 1 and 3).

Figure 5:
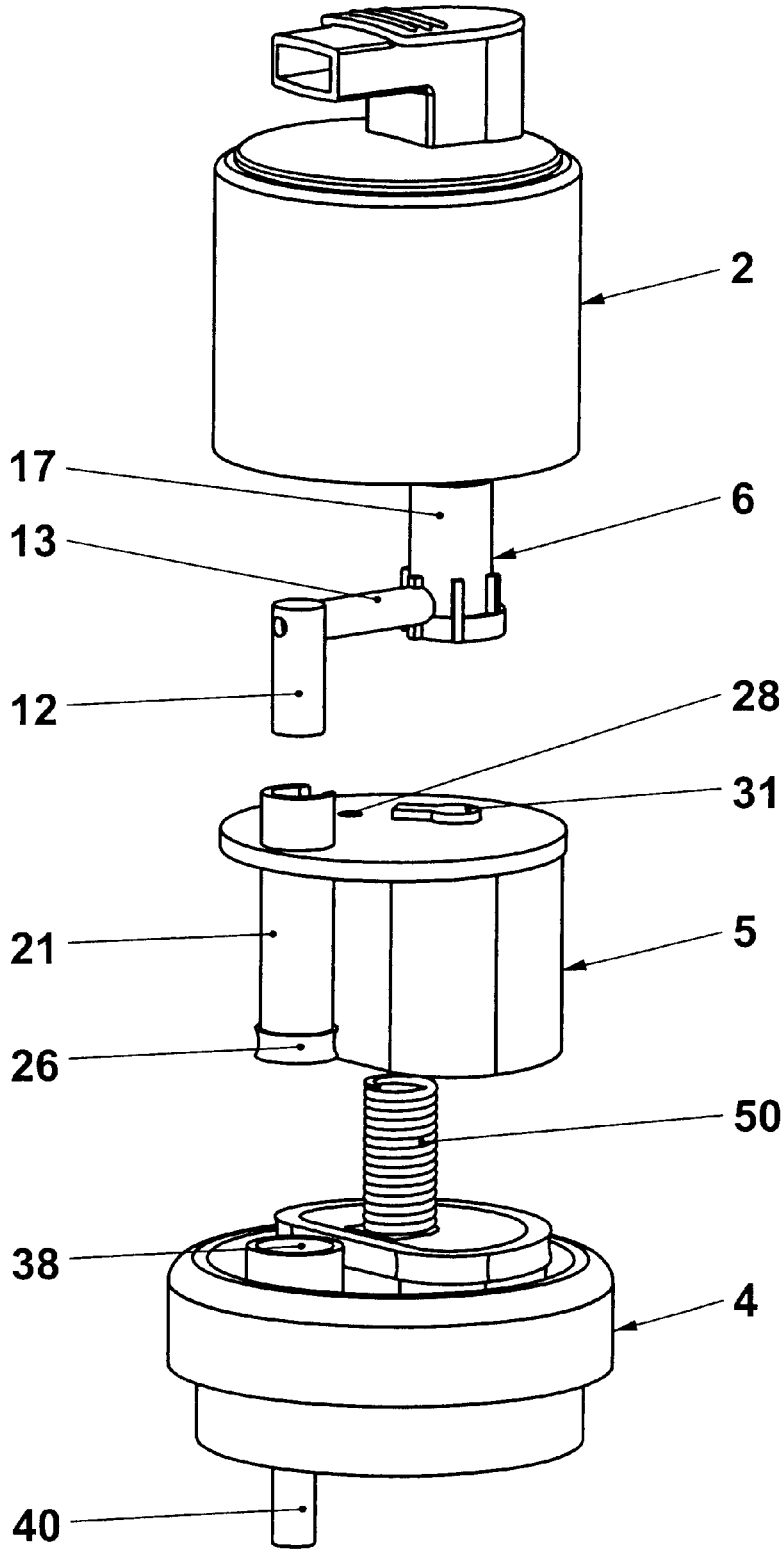

The various parts 2 through 6 of the foam spraying apparatus 1 can be seen still more clearly in the exploded view shown in FIG. 5 which should be self-explanatory in combination with the FIGS. 1 through 4.

The foam spraying apparatus 1 described above now functions as follows:

For generating foam the spraying head 2 is pressed down against the helical pressure spring 50. In this manner the air present in the air chamber 20 is pressed via the outlet opening 29 and the outlet valve 31 into the mixing chamber 14. Simultaneously also the liquid in the liquid chamber 38 is conveyed by the compression via the flow chamber 12 into the mixing chamber 14. The air stream thus mixes in the mixing chamber with the liquid and this mixture of air and liquid is transferred via the first sieve 18 into the foaming chamber 17 where the foam formed is pressed through the second sieve 19 and flows via the foam conveying tube 10 through the outlet opening 9 of the spraying head 2. Then the spraying head 2 is released again in which process the intermediate part 5 and the base part 4 are pressed away from each other under the influence of the helical spring 50 in such a manner that air is sucked in via the air intake opening into the air chamber 20. At the same time via the suction tube 40 liquid is sucked from the bottle (not shown) and via the valve 44 is transported into the liquid chamber 38. Each time the spraying head 2 is depressed a small quantity of foam thus is formed which, among other factors, depends on the diameters of the tapered inlet openings 15 and 16 leading into the mixing chamber 14, on the mesh opening size of the two sieves 18 and 19 and on the size of the foam chamber 17.

Manufacture of the foam spraying apparatus 1 described above is effected as follows:

The spraying head 2, the base part 4, the intermediate part 5 and the insert 6 are made from a synthetic material such as Duroplast using an injection moulding process known as such. For this purpose negative moulds are placed into an injection mould and the synthetic material heated to the melting temperature is injected under high pressure into the injection mould. Simultaneously with the manufacture of the parts 2, and 4 through 6 also the rubber elastic elements (disks 30 and 31 with the connecting cross-member 32; disk 24 with sealing ring 26 and connecting cross-member 25; disk 44 and sealing ring 41 with L-shaped connecting cross-member 45) which are made from an elastomer material such as e.g. LDPE or a similar material, are placed in the injection mould in such a manner that these elements already in the manufacturing process are connected to the co-ordinated parts. In this manner the foam spraying apparatus 1 can be manufactured in a particularly simple and cost efficient manner.

One of skill in the art would acknowledge that the foam spraying apparatus 1 described above is not limited exclusively to the embodiment shown. In a slightly changed embodiment the circular cylindrical piston 21 can be arranged coaxially with the axis of the intermediate part 5 instead of eccentrically in which arrangement the pressure spring 59 surrounds the piston 21 and the insert 6 is laid out correspondingly shorter. Since only very few elements are required for producing the foam spraying apparatus 1 which now can be manufactured much faster in a easy manufacturing process, a material saving and thus environmentally feasible production process is achieved. Energy cost for the manufacture of the foam spraying apparatus 1 also can be lowered very substantially in comparison to the manufacturing methods known thus far.

We claim:

1. A foam spraying apparatus for a liquid container comprising:

(a) a first piston-and-cylinder unit for air, comprising a first cylinder and a first piston, the first unit having an inlet valve and an outlet valve;

(b) a second piston-and-cylinder unit for liquid, comprising a second cylinder and a second piston, the second unit having an inlet valve and an outlet valve and cooperating with the first unit by a mutual coupling;

(c) a mixing chamber for mixing air and liquid; and (d) a spraying head provided with a foam delivery opening, wherein the first cylinder and the second piston are interconnected to form an intermediate part and the second cylinder and the first piston are interconnected to form a base part, and wherein the intermediate part and the base part mesh and are moveable relative to each other.

2. The foam spraying apparatus according to claim 1, wherein the second piston is laid out eccentrically with respect to the first cylinder.

3. The foam spraying apparatus according to claim 1, wherein the first piston and second piston each are provided with a sealing ring.

4. The foam spraying apparatus according to claim 1, wherein the mixing chamber is formed by an insert between the spraying head and the intermediate part.

5. The foam spraying apparatus according to claim 4, wherein the mixing chamber is provided with a tapered inlet opening for the air and a tapered inlet for the liquid.

6. The foam spraying apparatus according to claim 5, wherein, seen in the flow direction, after the air inlet opening and the liquid inlet opening a first fine mesh sieve is arranged.

7. The foam spraying apparatus according to claim 6, wherein, seen in the flow direction, after the first sieve a foaming chamber and a second fine mesh sieve are arranged.

8. The foam spraying apparatus according to claim 1, wherein the spraying head, the insert, the intermediate part and the base part are made from a synthetic material formed by an injection moulding process.

9. A method of manufacturing a foam spraying apparatus according to claim 1, wherein the spraying head, the first piston and first cylinder of the first unit for the air and the second piston and second cylinder of the second unit for the liquid are injection moulded using a two component synthetic material.

10. A method according to claim 9, wherein the inlet and outlet valves of the first unit and second unit are made from a rubber elastic synthetic material and during injection moulding are surrounded by the intermediate and base parts coordinated to them.

11. The foam spraying apparatus according to claim 1, wherein the first cylinder and the second piston form a unit body as the intermediate part and the first piston and the second cylinder form a unit body as the base part.

* * * * *

UNITED STATES PATENT AND TRADEMARK OFFICE

CERTIFICATE OF CORRECTION

PATENT NO. : 6,547,162 B1
DATED : April 15, 2003
INVENTOR(S) : Jeroen de Regt and Roy van Swieten It is certified that error appears in the above-identified patent and that said Letters Patent is hereby corrected as shown below:

Column 2,
Line 47, replace "is obtained A" with -- is obtained. A --
Line 53, replace "be achieved It proves" with -- be achieved. It proves --

Column 6,
Line 17, replace "tapered inlet for the liquid." with -- tapered inlet opening for the liquid. --

Signed and Sealed this

Sixth Day of January, 2004

JAMES E. ROGAN
*Director of the United States Patent and Trademark Office*